US005886678A

United States Patent [19]

Katakura et al.

[11] Patent Number: 5,886,678

[45] **Date of Patent: *Mar. 23, 1999**

[54] DRIVING METHOD FOR LIQUID CRYSTAL DEVICE

[75] Inventors: Kazunori Katakura; Akira Tsuboyama, both of Atsugi; Manabu Iwasaki, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 525,195

[22] Filed: Sep. 8, 1995

[30] Foreign Application Priority Data

Sep. 12, 1994 [JP] Japan ..... 6-217278

[51] Int. Cl.[6] ..... G09G 3/36

[52] U.S. Cl. ..... 345/94; 345/97

[58] Field of Search ..... 345/87, 94, 95, 345/96, 97, 208, 209, 210; 349/33

[56] References Cited

U.S. PATENT DOCUMENTS

| | | | |
|---|---|---|---|
| 4,367,924 | 1/1983 | Clark et al. | 350/334 |
| 4,639,089 | 1/1987 | Okada et al. | 350/341 |
| 4,655,561 | 4/1987 | Kanbe et al. | 350/350 |
| 4,674,839 | 6/1987 | Tsuboyama et al. | 350/334 |
| 4,776,676 | 10/1988 | Inoue et al. | 350/350 |
| 4,778,259 | 10/1988 | Kitayama et al. | 350/350 |
| 4,836,656 | 6/1989 | Mouri et al. | 350/350 |
| 4,902,107 | 2/1990 | Tsuboyama et al. | 350/350 |
| 4,923,285 | 5/1990 | Ogino et al. | 350/331 T |
| 5,026,144 | 6/1991 | Taniguchi et al. | 350/350 |
| 5,033,822 | 7/1991 | Ooki et al. | 350/331 |
| 5,041,821 | 8/1991 | Onitsuka et al. | 340/784 |
| 5,058,994 | 10/1991 | Mihara et al. | 359/56 |
| 5,091,723 | 2/1992 | Kanno et al. | 340/784 |
| 5,189,536 | 2/1993 | Hanyu et al. | 359/56 |
| 5,267,065 | 11/1993 | Taniguchi et al. | 359/56 |
| 5,321,419 | 6/1994 | Katakura et al. | 345/97 |
| 5,469,281 | 11/1995 | Katakura et al. | 359/56 |
| 5,471,229 | 11/1995 | Okada et al. | 345/89 |

FOREIGN PATENT DOCUMENTS

| | | |
|---|---|---|
| 56-107216 | 8/1981 | Japan . |
| 2281233 | 11/1990 | Japan . |
| 2281238 | 11/1990 | Japan . |

*Primary Examiner*—Regina Liang

*Attorney, Agent, or Firm*—Fitzpatrick, Cella, Harper & Scinto

[57] ABSTRACT

A liquid crystal device is constituted by an electrode matrix including scanning electrodes and data electrodes intersecting the scanning electrodes, and a liquid crystal disposed to form a pixel at each intersection of the data electrodes and the scanning electrodes. The liquid crystal device is driven by sequentially applying a scanning selection signal to the scanning electrodes, and in synchronism with the scanning selection signal, applying data signals to the data electrodes, each data signal comprising a selection pulse of a first polarity having a pulse width ΔT for determining a display state of a pixel and pulses of a second polarity disposed before and after the selection pulse, wherein the data signals are applied successively with a pause period shorter than ΔT, preferably about ΔT/2, between succeeding two data signals.

4 Claims, 14 Drawing Sheets

D: DATA SIGNAL FOR "DARK"
B: DATA SIGNAL FOR "BRIGHT"

DRIVING METHOD FOR LIQUID CRYSTAL DEVICE

FIELD OF THE INVENTION AND RELATED ART

The present invention relates to a driving method for a liquid crystal device used in display apparatus for displaying characters or images, e.g., for personal computers, and television receivers, light valves for liquid crystal printers, etc., and particularly a driving method for a liquid crystal device suitably applicable to a matrix display apparatus for effecting a display based on two stable states of a ferroelectric liquid crystal.

Hitherto, there have been well known liquid crystal devices which comprise an electrode matrix of scanning electrodes and a liquid crystal disposed so as to form a pixel for image data display at each intersection of the electrodes. Among these, a ferroelectric liquid crystal device having bistability and a high speed responsiveness to an electric field is particularly expected to be a high-speed and memory-type display device, e.g., as proposed in U.S. Pat. Nos. 4,655,561 and 4,836,656, and Japanese Laid-Open Patent Application (JP-A) 56-107216. Further, many proposals have also been made regarding display methods for matrix drive of ferroelectric liquid crystal devices, inclusive of practical display methods as disclosed in U.S. Pat. No. 5,267,065, and JP-A 2-281238.

FIG. 1 shows a known set of drive signal waveforms for a liquid crystal device as descried in the above U.S. Pat. No. 5,267,065. Referring to FIG. 1, at A is shown a scanning selection signal; B, a scanning non-selection signal; C, a data signal for displaying "bright"; and D, a data signal for displaying "dark". Herein, "bright" and "dark" are respectively an optical state selectively determined based on a combination of an orientation state of liquid crystal molecules and a polarizing device. A conventional display device using a ferroelectric liquid crystal is accompanied with a problem that the threshold characteristic for the display device can change after long hours of standing at one stable state of liquid crystal molecules due to an interaction at the boundary between the substrate and the liquid crystal layer. Ferroelectric liquid crystal molecules are liable to be fluctuated by a pulse below the threshold particularly in a low temperature region. In the display method disclosed in U.S. Pat. No. 5,267,065 or JP-A 2-281233, the data signal voltages shown at C and D in FIG. 1 are incessantly applied so as to provide a high frame frequency. When such pulses having a width of $\Delta T$ are continually applied, it is possible in some cases that the fluctuation of liquid crystal molecules during a scanning non-selection period is enhanced to cause a local inversion in a display, thus failing to retain a good display.

Further, it has been also found that a defective alignment of liquid crystal molecules is liable to occur in a low temperature environment of below 20° C. A ferroelectric liquid crystal can assume a chevron structure composed of bent smectic layers and including a C1 alignment state or a C2 alignment state as will be described hereinafter. At a low temperature, the C1 alignment is preferred but the C2 alignment can locally occur though undesirable. If such C2 alignment molecules are present locally in C1 alignment molecules, adequate control of transmittance through the liquid crystal layer cannot be effected, resulting in a lower contrast. Such problems regarding alignment characteristic have been believed to be solved by selection of materials constituting liquid crystal devices and physical designing factors thereof, such as an improvement in liquid crystal material and an improvement in alignment film, and trials in such directions have been made.

SUMMARY OF THE INVENTION

In view of the above-mentioned technical problems, a principal object of the present invention is to provide a driving method for a liquid crystal device capable of suppressing unintentional inversion of liquid crystal molecules.

Another object of the present invention is to provide a driving method for a liquid crystal device having a broad latitude of driving conditions for providing a desired display state.

A further object of the present invention is to provide a driving method for a liquid crystal device capable of suppressing occurrence of alignment defects.

A still further object of the present invention is to provide a driving method for a liquid crystal device capable of providing good display characteristics even at low temperatures.

According to our study for the above purpose, it has been found possible to suppress occurrence of undesired display region and occurrence of the above-mentioned C2 alignment, thus resulting in less alignment defects, by using certain types of drive signals.

According to the present invention based on such a discovery, there is provided a driving method for a liquid crystal device of the type comprising an electrode matrix comprising scanning electrodes and data electrodes intersecting the scanning electrodes, and a liquid crystal disposed to form a pixel at each intersection of the data electrodes and the scanning electrodes; said driving method comprising:

sequentially applying a scanning selection signal to the scanning electrodes, and in synchronism with the scanning selection signal, applying data signals to the data electrodes, each data signal comprising a selection pulse of a first polarity having a pulse width $\Delta T$ for determining a display state of a pixel and pulses of a second polarity disposed before and after the selection pulse, wherein said data signals are applied successively with a pause period shorter than $\Delta T$ between succeeding two data signals.

It is preferred that the scanning selection signal includes a reset pulse having a pulse width larger than the pause period. It is also preferred that a total of duration of each data signal and the pause period is equal to one horizontal scanning period. It is also preferred that the pause period is synchronized with a reset pulse applied to any one of the scanning electrodes.

It is further preferred that the pulses of a second polarity disposed before and after the selection pulse (i.e., auxiliary pulses) each have a duration of $\Delta T/2$, and the pause period has a duration of $\Delta T/2$ so as to prevent the continuation of the auxiliary pulses.

These and other objects, features and advantages of the present invention will become more apparent upon a consideration of the following description of the preferred embodiments of the present invention taken in conjunction with the accompanying drawings.

BRIE DESCRIPTION OF THE DRAWINGS

FIG. 1 is a waveform diagram showing a set of drive signals conventionally used for driving a liquid crystal device.

FIGS. 2A–2C each show a succession of data signals.

DESCRIPTION OF THE PREFERRED EMBODIMENTS

The driving method according to the present invention is principally characterized by inclusion of a pause period in one horizontal scanning period of data signals for multiplexing drive of a liquid crystal device including an electrode matrix.

Figure 2A:
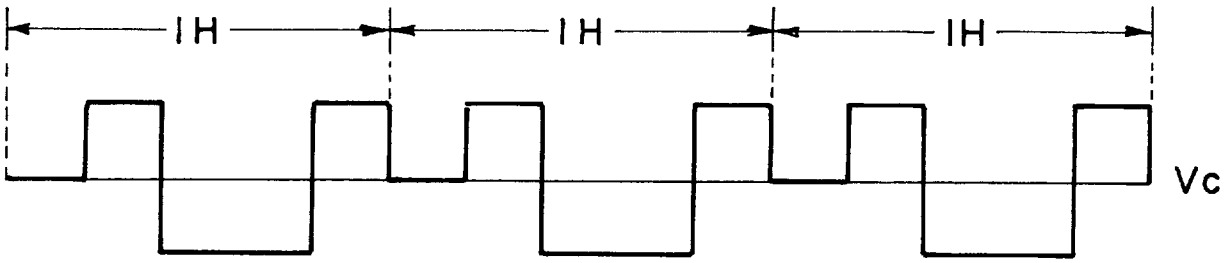
Figure 2B:
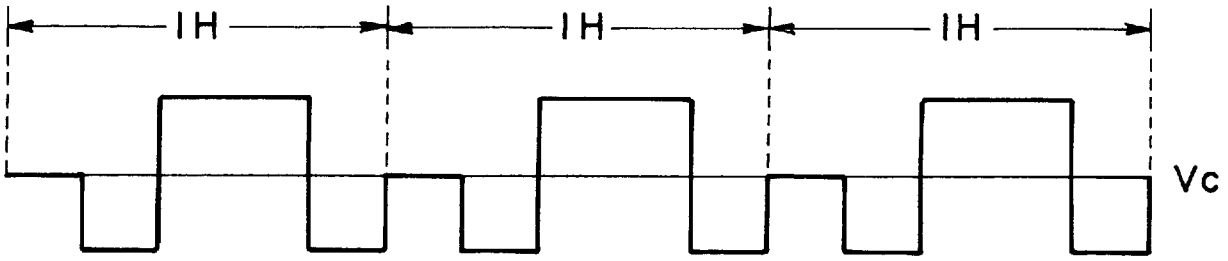
Figure 2C:
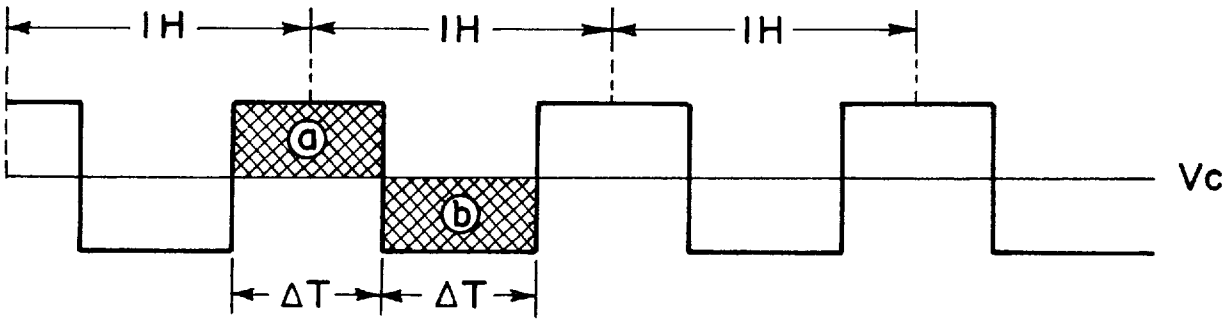

Referring to FIGS. 2A–2C, FIGS. 2A and 2B show successions of two types of data signals used in the present invention, and FIG. 2C shows a comparative waveform including a succession of data signals with no pause period.

According to our experiments for studying the relationship between AC pulses and liquid crystal molecular fluctuation, it has been found that a different form of AC pulses during the period of non-selection provides a different degree of liquid crystal molecular fluctuation. Referring again to FIGS. 2A–2C, the waveform shown in FIG. 2C is an AC waveform for applying a positive pulse a and a negative pulse b alternately and continuously. FIG. 2A shows a waveform obtained by dividing the pulse a in FIG. 2C into two equal pulses between which a pause period shorter than ΔT is inserted. FIG. 2B shows a waveform obtained by dividing the pulse b in FIG. 2C into two equal pulses between which a pause period shorter than ΔT is inserted. All the waveforms shown in FIGS. 2A–2C have an identical effective value (i.e., an identical product of amplitude×pulse width of pulses of one polarity in a period of 1 H). In our experiments, the degree of liquid crystal molecular fluctuation was changed depending on any of the waveforms shown in FIGS. 2A–2C applied thereto. When two molecular orientation states of a chiral smectic liquid crystal are denoted by U1 (bright) and U2 (dark) for convenience with the proviso that the inversion from U1 to U2 is caused by a negative polarity pulse, it has been found that the liquid crystal in U1 state is fluctuated in a larger degree when supplied with pulse b and the liquid crystal in U2 state is fluctuated in a larger degree when supplied with pulse a.

More specifically, if 1 H is taken as a unit period, the waveforms shown in FIGS. 2A and 2B always include a pause period at a reference potential Vc which is present at the beginning of each unit period, when such unit period continues. On the other hand, in the waveform shown in FIG. 2C, pulse components of an identical polarity can continue from the end of a preceding unit period to the beginning of a subsequent unit period and, as a result of continuation of the pulse components, an undesirable inversion is liable to occur.

Figure 3:
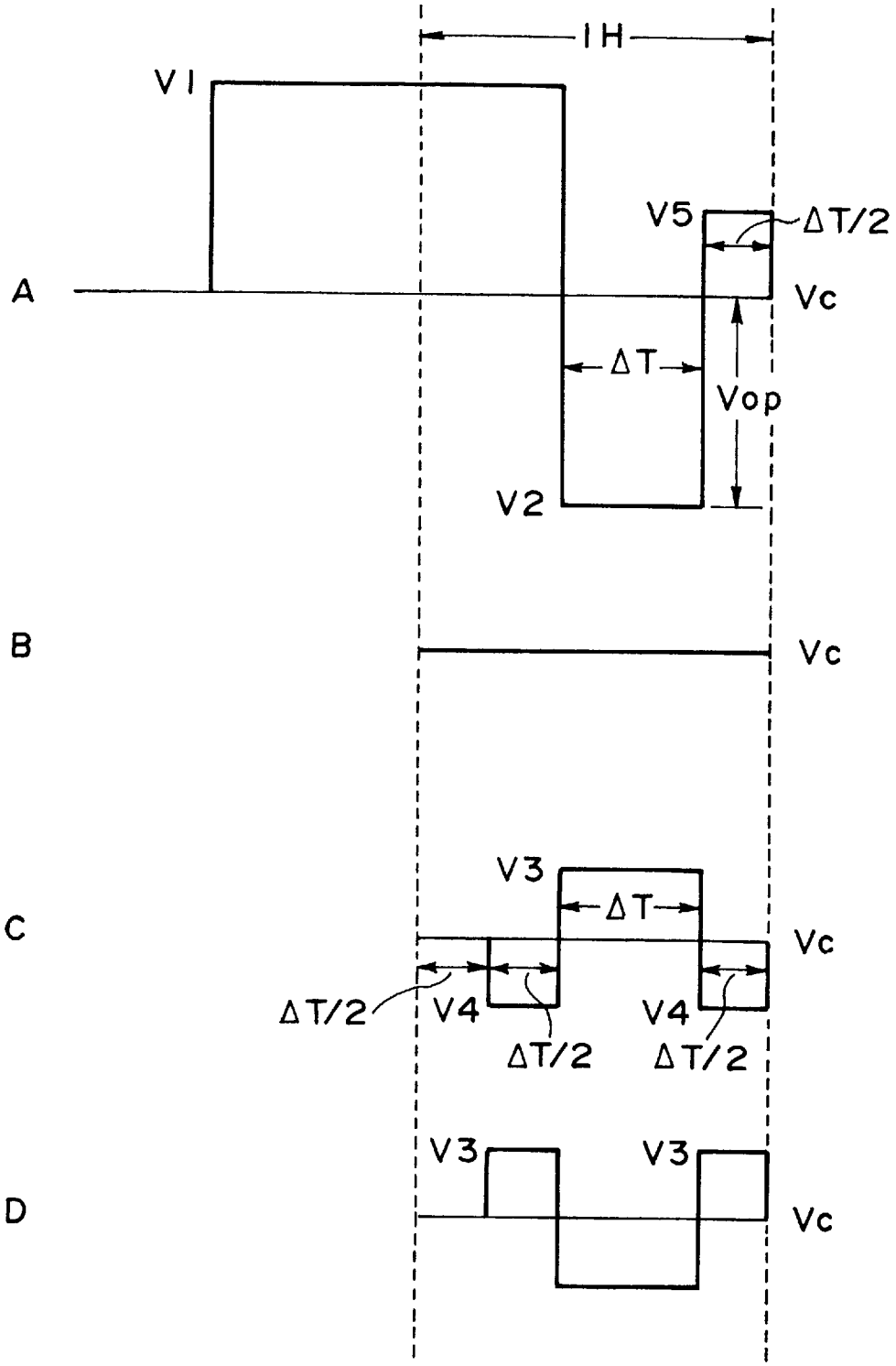
FIG. 3 is a waveform diagram showing an example set of drive signals used in the invention.

FIG. 3 is a waveform diagram showing a set of drive signals used in an embodiment of the present invention. At A is shown a scanning selection signal; B, a scanning non-selection signal; and C, a data signal for displaying a bright state and D, a data signal for displaying a dark state, respectively in combination with a polarizing device. In FIG. 3, the potential of a non-selected scanning electrode is taken at a reference potential Vc. 1 H represents a horizontal scanning period, and one frame scanning period 1F for selecting all n scanning electrodes is calculated as 1F=1H×n.

Some consideration will be again given on "fluctuation". When a pulse period of ΔT/2 shorter than ΔT is added into a data signal as shown in FIG. 3, even if a pixel in U1 state is supplied with a combination of signals B and D successively, a pulse component like b shown in FIG. 2C is not applied. As a result, one time of application of pulse b is reduced in one frame when one other pixel for displaying U1 state is present on an identical data electrode with the pixel concerned. If two other pixels are present, two times are reduced and, if three other pixels are present, three times are reduced. In an extreme case, when all the pixels on a data electrode noted are to display U1 state, no pulse b is applied and each pixel on the data electrode noted is supplied with a succession of data signals as shown in FIG. 2B. In this way, though depending on an image pattern to be displayed, the number of times of application of pulse b is reduced considerably than in the conventional method. Similarly, the number of times of application of a pulse component like a in FIG. 2A to a pixel in U2 state is substantially reduced. As a result, the fluctuation by which the drive margin is restricted is suppressed to provide a large drive margin.

Figure 4:
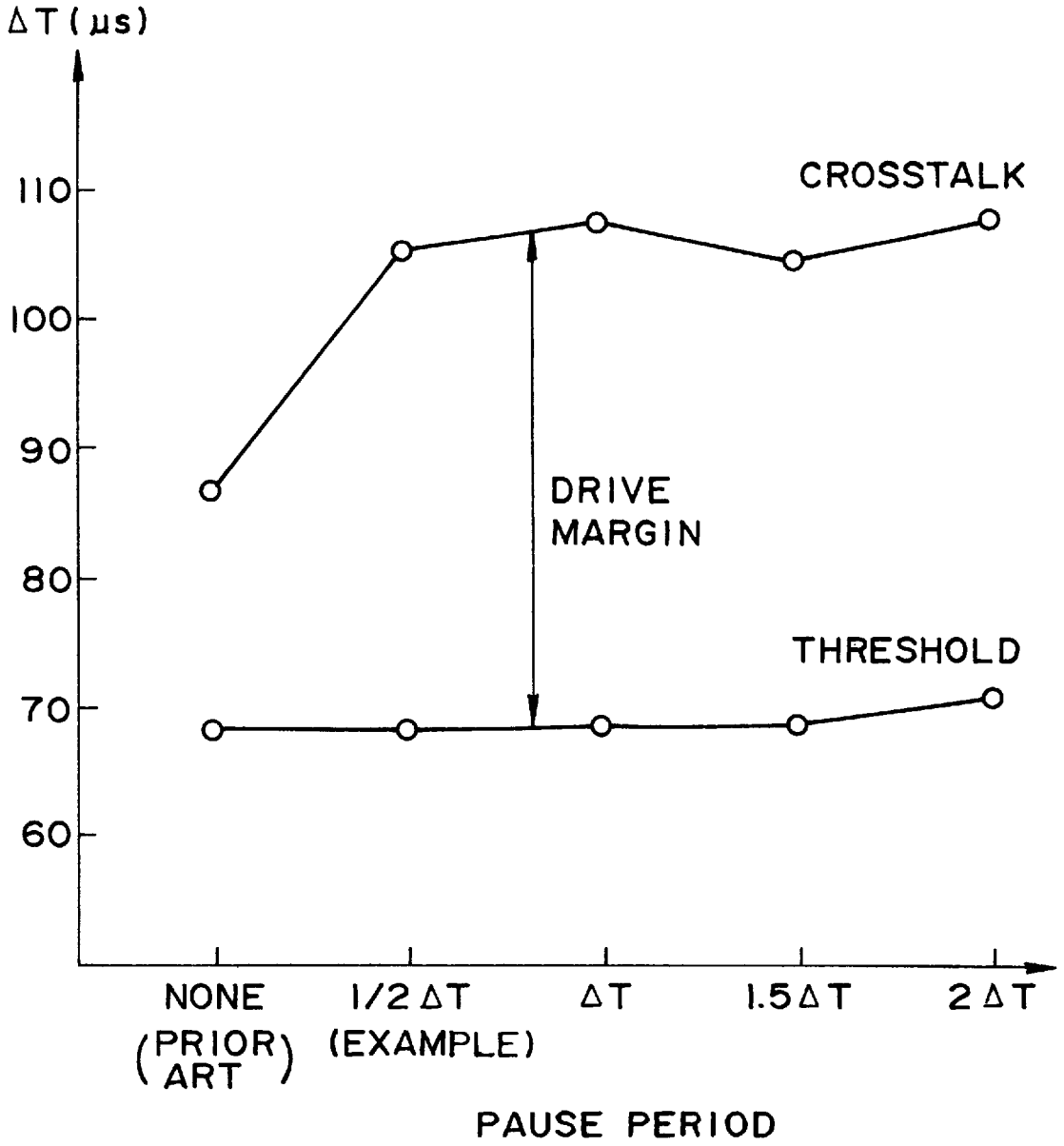
FIG. 4 is a graph showing a relationship between pause period and drive margin.

Further, we have studied a relationship between the pause period and the drive margin by increasing the pause period by an increment of ΔT/2. As a result, it has been found that the magnitude of drive margin is almost saturated around a pause period of ΔT/2 as shown in FIG. 4, which is based on a series of experiments which were conducted at a temperature of 10° C. and voltage signals shown in FIG. 3 were set to have amplitudes V1=14.3 volts, V2=−14.3 volts, V3=5.7 volts, V4=−5.7 volts and V5=6.4 volts to examine a range of ΔT allowing a good display. In order to provide a high frame frequency, too long a pause period is not desired. The pause period may preferably be shorter than ΔT and at least ΔT/4 and may optimally be ΔT/2 in view of both the drive margin and the drive speed. The pause period can be made shorter than ΔT/2 if desired, but may preferably be set so as to provide a ratio of a simple integer between the pause period and the respective pulses in view of drive circuit designing. This is because a basic clock pulse width in the drive circuit system is set by dividing the period 1H so as to provide the selection pulse V2 and auxiliary pulses V3–V5 with duration which are multiplication with an integer of the pause period and therefore too short a basic clock pulse is required if the ratios among the respective pulse widths are complex. As a result, a circuit having a unnecessarily high response speed can be necessitated to result in an increased production cost. This difficulty can be obviated by setting ratios of a simple integer between the pause period and the respective pulses as mentioned above.

As described above, in a preferred embodiment of the present invention, the number of application of pulses causing a fluctuation of U1 state and U2 state, respectively, is reduced by a pause period of $\Delta T/2$, thereby satisfying a sufficient drive margin, a high frame frequency and a simple drive circuit in combination.

In this regard, it should be noted that JP-A 4-134422 discloses a drive signal including a pause period, which drive signal is utterly different from the one used in the present invention in design factor and object such that the pause period is not shorter than $\Delta T$ and no reset pulse is contained.

Next, solution of alignment defects by the driving method according to the present invention will now be described with reference to FIG. 5.

A ferroelectric liquid crystal is generally a chiral smectic liquid crystal having a chiral smectic C phase (SmC*) or H phase (SmH*) in a specific temperature region.

Figure 5:
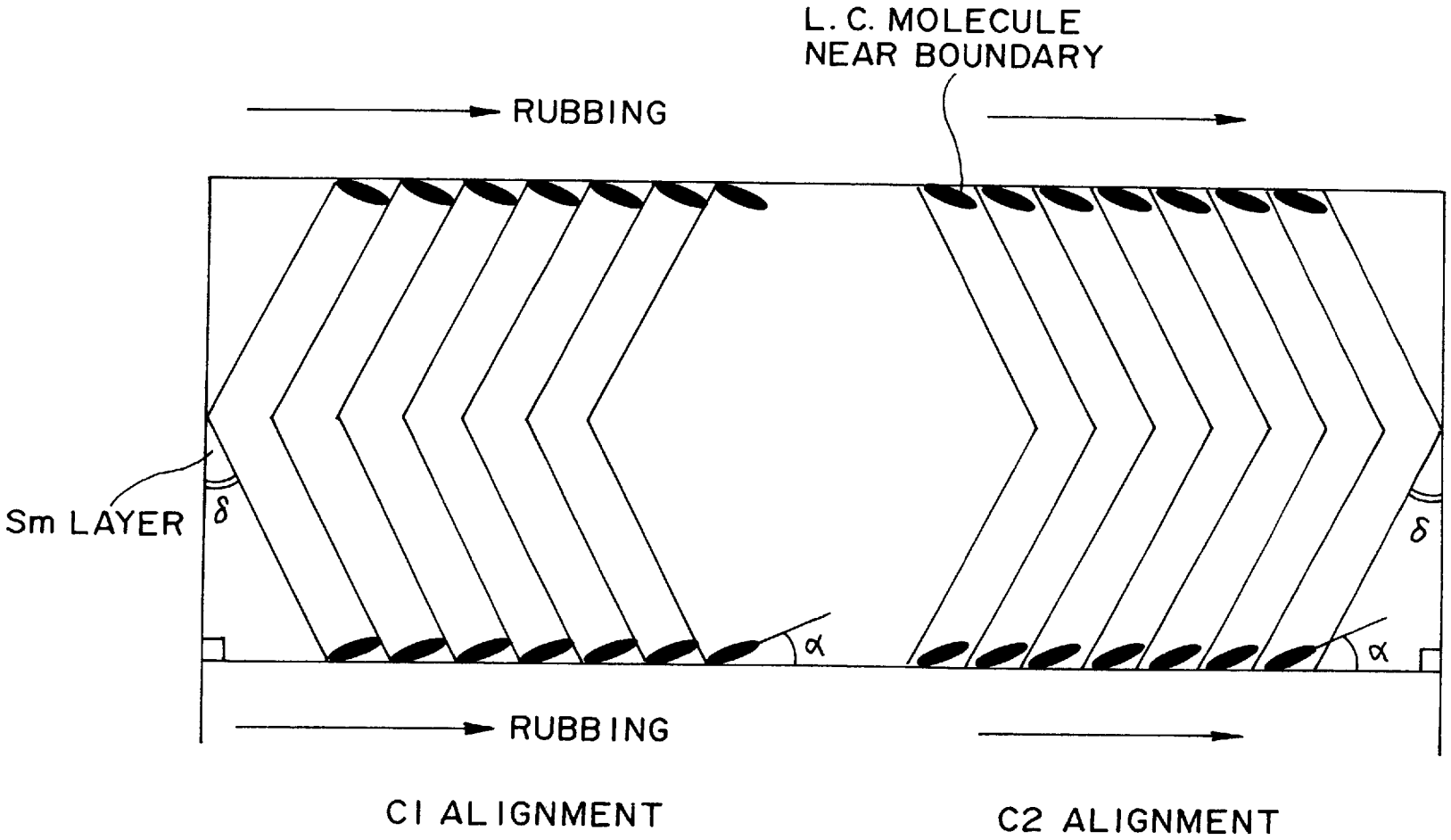
FIG. 5 is a schematic view showing C1 alignment and C2 alignment in a chevron structure.

In a type of liquid crystal device using such a ferroelectric liquid crystal, the chiral smectic liquid crystal may assume a chevron structure wherein smectic layers are bent in possibly two alignment structures of C1 alignment and C2 alignment as shown in FIG. 5. If these C1 alignment portion and C2 alignment portion are co-present in mixture, there may be encountered difficulties such that the switching characteristics are different between the C1 alignment portion and C2 alignment portion, and an alignment defect occurs at the boundary between the C1 alignment portion and C1 alignment portion, and the image qualities are deteriorated due to a lowering in contrast and a decrease in drive margin. The occurrence of such a mixture of C1 and C2 alignments may be prevented by rubbing two substrates in directions which are parallel and identical to each other and providing a controlled pretilt to liquid crystal molecules at the boundary with a substrate, thereby providing a homogeneous alignment state (e.g., as disclosed in Ferroelectrics 1993, vol. 149, pp. 283–294).

Figure 1:
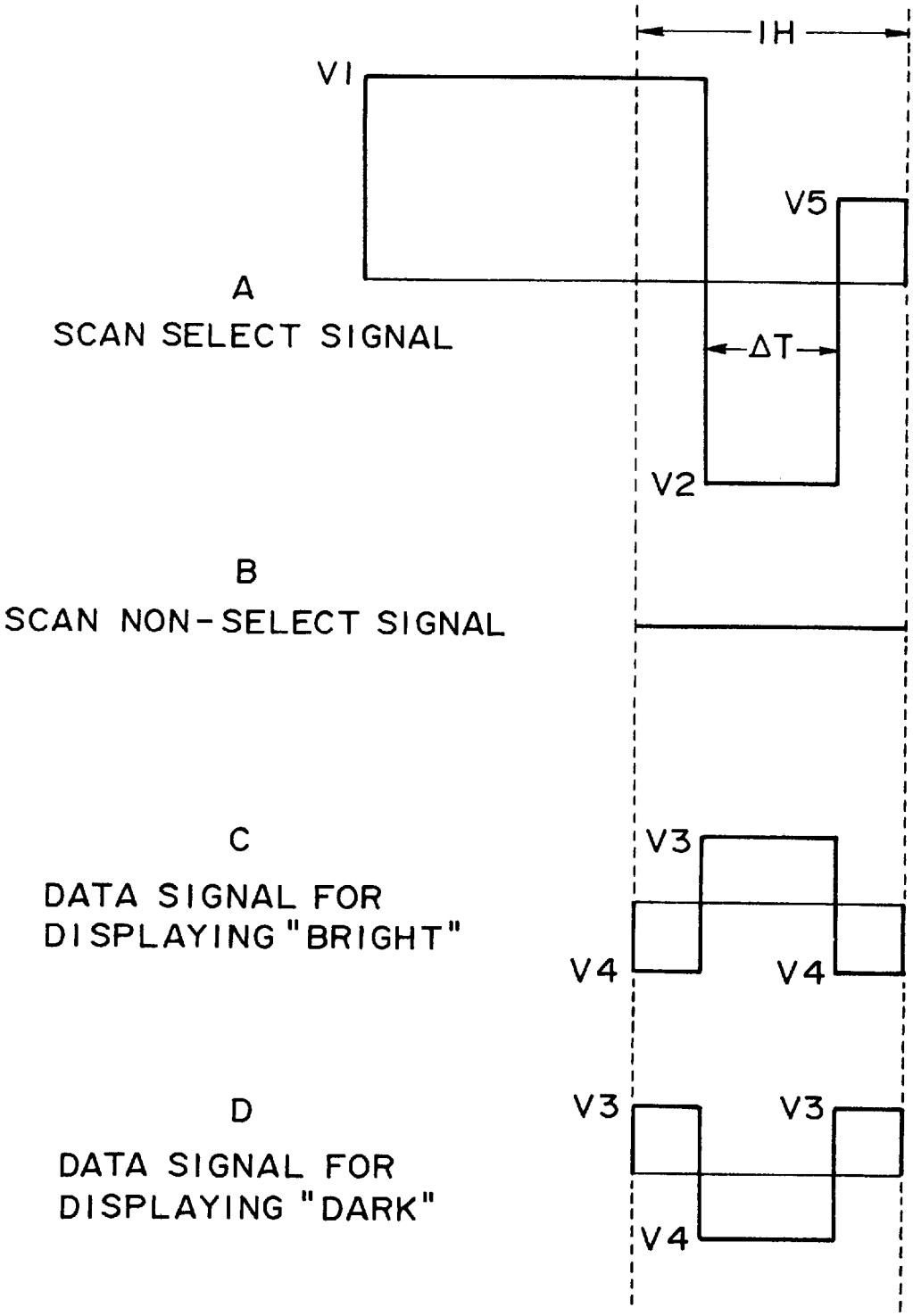
FIG. 1 PRIOR ART

By applying the above-mentioned technique, it is possible initially to obtain a sufficiently homogeneous alignment state but, if a convention set of drive signals as shown in FIG. 1 are applied, the liquid crystal in such a homogeneous alignment state under no electric field can cause a mixture of the C1 and C2 alignment structure under a low temperature condition.

In order to obtain a high contrast with a ferroelectric liquid crystal, it is necessary to stably form a uniform alignment state which is free from twisting of liquid crystal molecules in a direction normal to the substrates. This is desirably accomplished by C1 alignment as shown in FIG. 5, which may be desirably achieved by appropriate selection of parameters of cell designing and cell materials so as to satisfy a condition for forbidding C2 alignment represented by $\Theta < \alpha + \delta$ . . . (1), wherein $\Theta$ denotes a tilt angle; $\alpha$, a pretilt angle; and $\delta$, a layer inclination angle, respectively of the liquid crystal (as disclosed in U.S. Pat. No. 5,189,536).

However, even if the C1 alignment is stably obtained initially by satisfaction of the above condition, it is possible that the C2 alignment appears in the C1 alignment structure under application of drive signals to result in spot defects in a displayed image in some cases as has been described hereinabove.

This problem becomes pronounced particularly at a low temperature side as the smectic layer inclination angle $\delta$ from the substrate normal characterizing the above-mentioned chevron structure of a chiral smectic liquid crystal is decreased as the temperature is lowered from around room temperature to a lower temperature.

Figure 6:
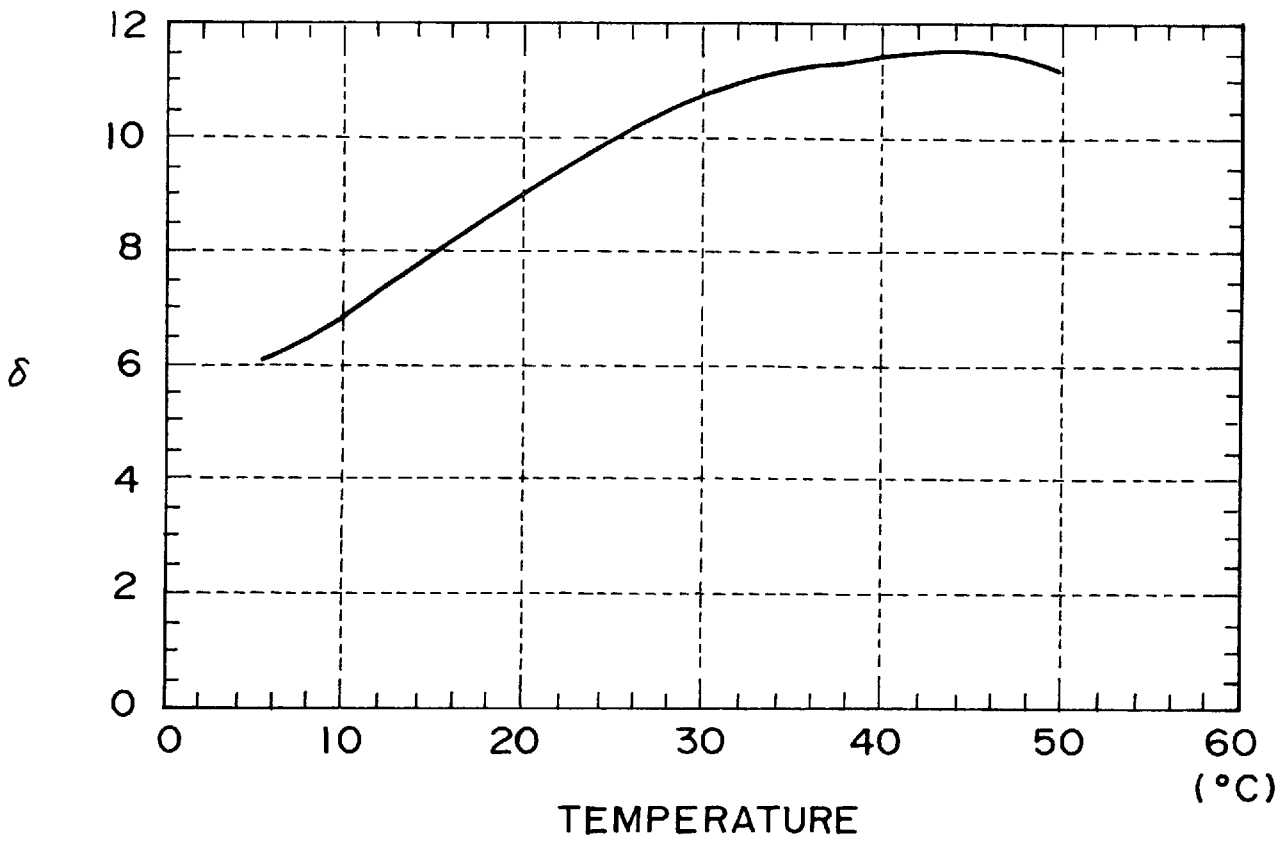
FIG. 6 is a graph showing a temperature-dependence of a liquid crystal material used in the invention.

A temperature-dependence of the layer inclination angle $\delta$ is shown in FIG. 6, for an example of liquid crystal composition, hereinafter referred to as "liquid crystal composition A" having a pretilt angle of 18 degrees, a tilt angle of 13 degrees and a layer inclination angle of 11 degrees, respectively at 30° C., and having a phase transition series of:

$$\text{Iso.} \xrightarrow{92^\circ\,\text{C.}} \text{Ch.} \xrightarrow{85^\circ\,\text{C.}} \text{SmA} \xrightarrow{67^\circ\,\text{C.}} \text{SmC} \xrightarrow{-17^\circ\,\text{C.}} \text{Cryst.}$$

The liquid crystal composition A was obtained by mixing a fluorine-containing compound as a chiral dopant to a mesomorphic compound having a phenylpyrimidine skeleton.

The reason for the occurrence of the C2 alignment state under application of drive signals may be considered that, under continual application of data signal waveforms, liquid crystal molecules near the boundary having a pretilt angle a determined by the aligning treatment receive a torque for directing the liquid crystal molecules to be parallel to the boundary as an interaction between the drive signals and the spontaneous polarization so as to provide a practically lower pretilt angle under drive, thus locally failing to satisfy the condition of the formula (1).

Through a trial and error study for suppressing the occurrence of the C2 alignment, it has been found possible to suppress the occurrence of the C2 alignment by disposing in a drive waveform a pause period in which no electric field is applied to the liquid crystal. It is considered that, by disposing the pause period, the torque acting for lowering the pretilt is removed to provide a substantially increased pretilt angle during the drive, thus allowing the satisfaction of the formula (1) condition.

It is assumed that the liability of occurrence of the C2 alignment at a low temperature is caused as an effect accompanying a lower C1–C2 transformation energy caused by a smaller layer inclination angle $\delta$ at a lower temperature.

In a preferred embodiment of the present invention, at least one of a writing drive voltage Vop and one horizontal scanning period 1H of a scanning selection signal is changed depending on a temperature condition. Corresponding thereto, the drive margin can be enlarged and it becomes possible to further suppress the occurrence of alignment defects.

Figure 7:
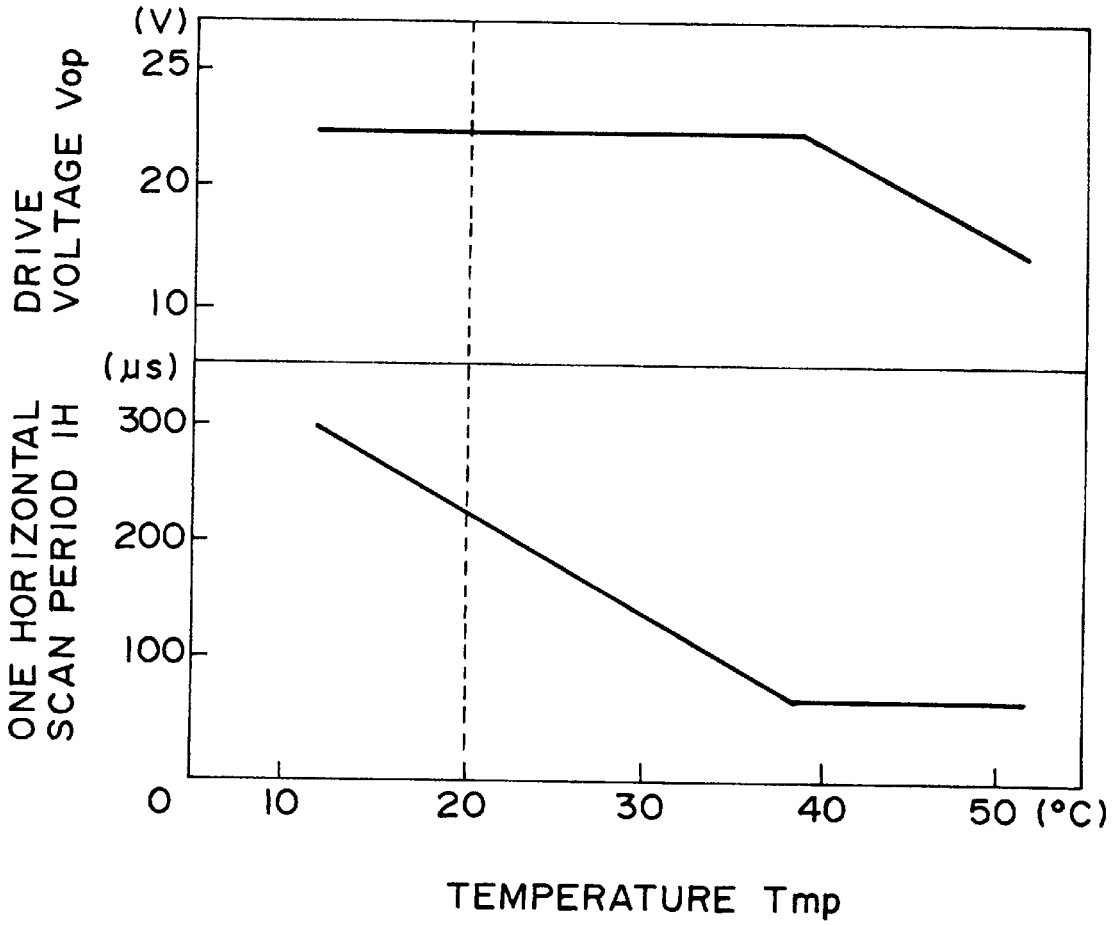
FIG. 7 is a graph showing a relationship between a drive voltage and temperature used in the invention.

FIG. 7 is a graph representing an example of the above-mentioned preferred embodiment where the drive voltage Vop and one horizontal scanning period 1H vary as functions of the temperature Tmp. More specifically, the functions in FIG. 7 are stored as temperature-compensation tables in a memory, such as RAM or ROM, and the set values for the drive voltage Vop and one horizontal scanning period 1H are read out from the memory depending on the detected temperature so as to drive the liquid crystal device based on the values.

It is further preferred that only Vop is changed at a higher temperature side and only 1H is changed at a lower temperature side as shown in FIG. 7. If Vop is increased and 1H is shortened, the bipolar pulses of data signals are caused to change polarities frequently, thereby providing an increased current passing through the liquid crystal and an increased heat generation. Such a heat generation is liable to result in a temperature fluctuation along a display panel extension and should desirably be avoided. The compensation scheme shown in FIG. 7 is less accompanied with such a heat generation and is thus preferred.

Figure 8:
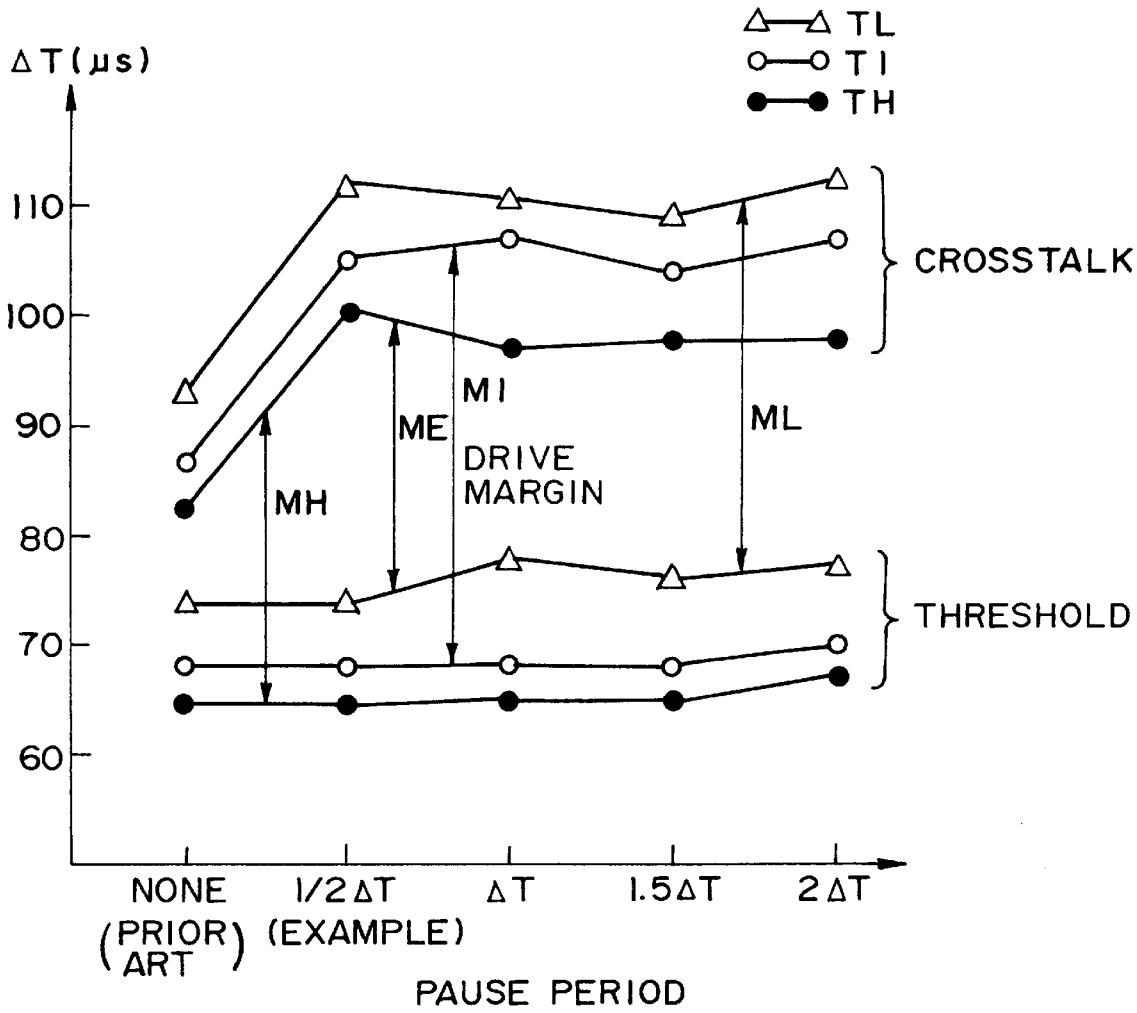
FIG. 8 is a graph showing a relationship between pause period and drive margin.

FIG. 8 is a graph showing an example of temperature-dependence of drive margin, wherein the abscissa represents a pause period between data signals and the ordinate represents a pulse width ΔT of a writing pulse in a scanning selection signal. Referring to FIG. 8, the upper three curves (or plots) represent pulse widths above which pixels on non-selected scanning lines begin to cause a crosstalk, and the lower three curves (or plots) represent pulse widths above which pixels on a selected scanning line can be switched, at a low temperature TL, a medium temperature T1 and a high temperature TH, respectively. The differences between the corresponding pairs of these upper and lower curves represent drive margins inclusive of M1 at the medium temperature, ML at the low temperature and MH at the high temperature. Further, ME represents a drive margin with which good display can be performed under a wide temperature condition ranging from the low temperature to the high temperature.

A further broad drive margin ME can be provided when a temperature-compensation table as represented by the curves shown in FIG. 7 is used.

A particularly broad drive margin can be obtained when a temperature-compensation table as represented by the curves shown in FIG. 7 is used by setting the pause period in a range of from ΔT/4 to below ΔT, particularly from ΔT/4 to 3ΔT/4.

Then, a scanning scheme used in a driving method according to the present invention will be described.

Figure 9:
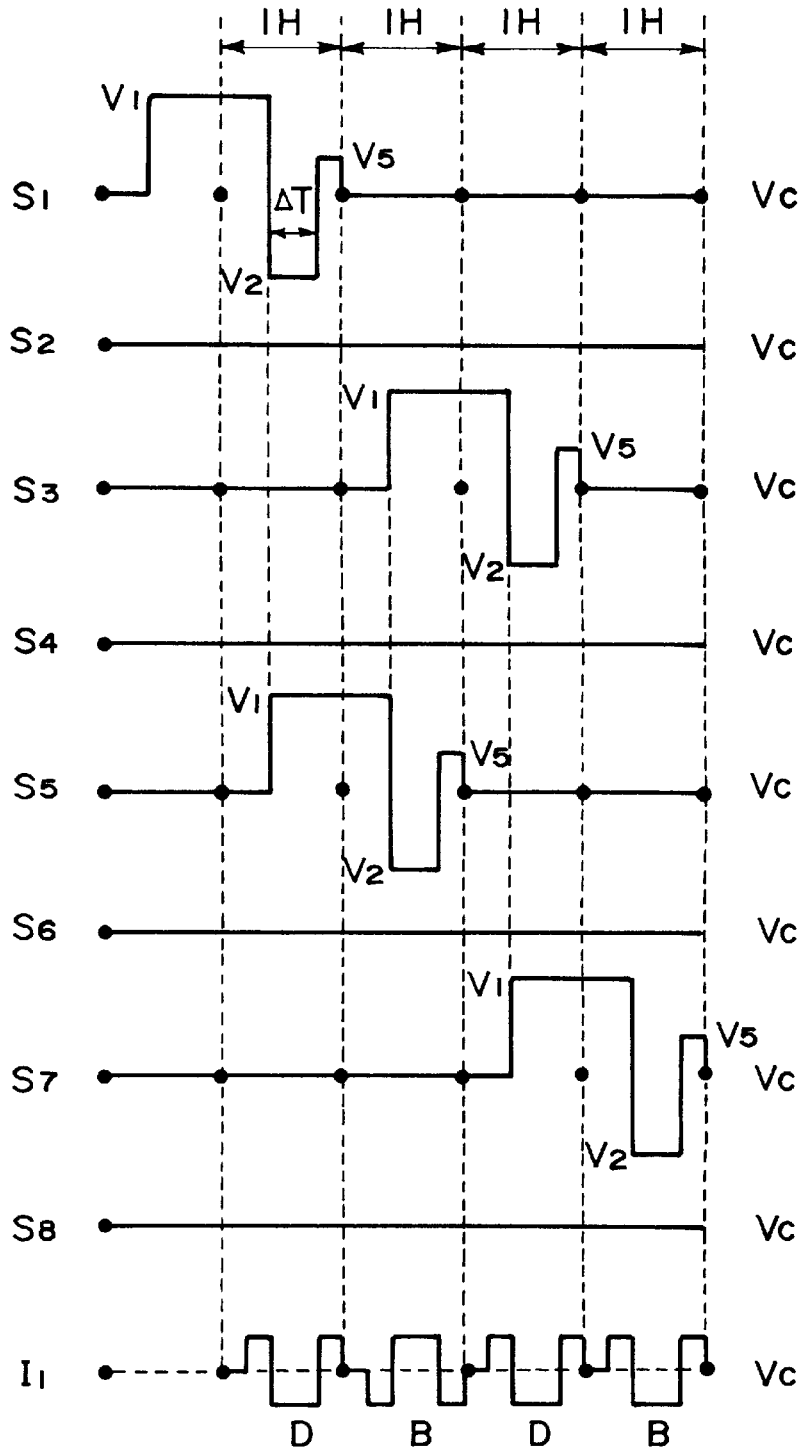
FIG. 9 is a time-serial waveform diagram showing a set of scanning signals and data signals used in the invention.

FIG. 9 is a time-serial waveform diagram showing a set of drive signals used in the scanning scheme, wherein at S1–S8 are shown scanning signals applied to scanning electrodes S1–S8 . . . , for example, and at $I_1$ is shown a data signal applied to a data electrode.

In case of an electrode matrix including 8 scanning electrodes for example, the simplest scanning scheme is a non-interlaced scanning scheme of sequentially selecting the scanning electrodes line by line in the order of S1, S2, S3, . . . S7 and S8. Another scanning scheme is an interlaced scanning scheme of selecting every other scanning electrode in the order of S1, S3, S5, S7, S2, S4, S6 and S8.

FIG. 9 shows a so-called multi-interlaced scanning scheme of selecting the scanning electrodes in the order of S1, S5, S3, S7, S2, S6, S4 and S8 in order to suppress the occurrence of flickering.

In an embodiment shown in FIG. 5, each scanning signal is designed to include a reset pulse $V_1$ with a pulse width of 2.5 ΔT, a writing pulse V2 with a pulse width of ΔT and an auxiliary pulse $V_5$ with a pulse width of ΔT/2. A pause period between data signals is synchronized with the reset pulse $V_1$ to have a duration of ΔT/2 synchronized with a ΔT/2 period subsequent to the auxiliary pulse $V_5$.

In a static image display or a motion picture display for displaying a picture changing over the entire picture area (or panel), it is preferred to repeat refresh scanning according to such a multi-interlaced scanning scheme.

In a preferred drive scheme accompanied with a partial image rewrite in an entire picture area, such as movement of a mouse cursor, scrolling of a window, or writing of characters in a window region, it is preferred to preferentially scan only the scanning lines corresponding to the rewritten image and the other scanning lines are scanned according to an interlaced or a multi-interlaced scanning scheme.

The reset pulse having an amplitude $V_1$ preferably having a pulse width larger than the width ΔAT of the writing or selection pulse $V_2$ and may preferably be started to be applied so as to immediately precede the commencement of a period ΔT for applying the pulse $V_2$ for selection of the scanning line concerned as shown in FIG. 9.

Further, a reset pulse $V_1$ applied to an (m+1)-th selected scanning electrode may be applied simultaneously as shown in FIG. 9 with or prior to application of the selection pulse $V_2$ to an m-th selected scanning electrode selected immediately prior to the (m+1)-th scanning electrode.

Figure 10:
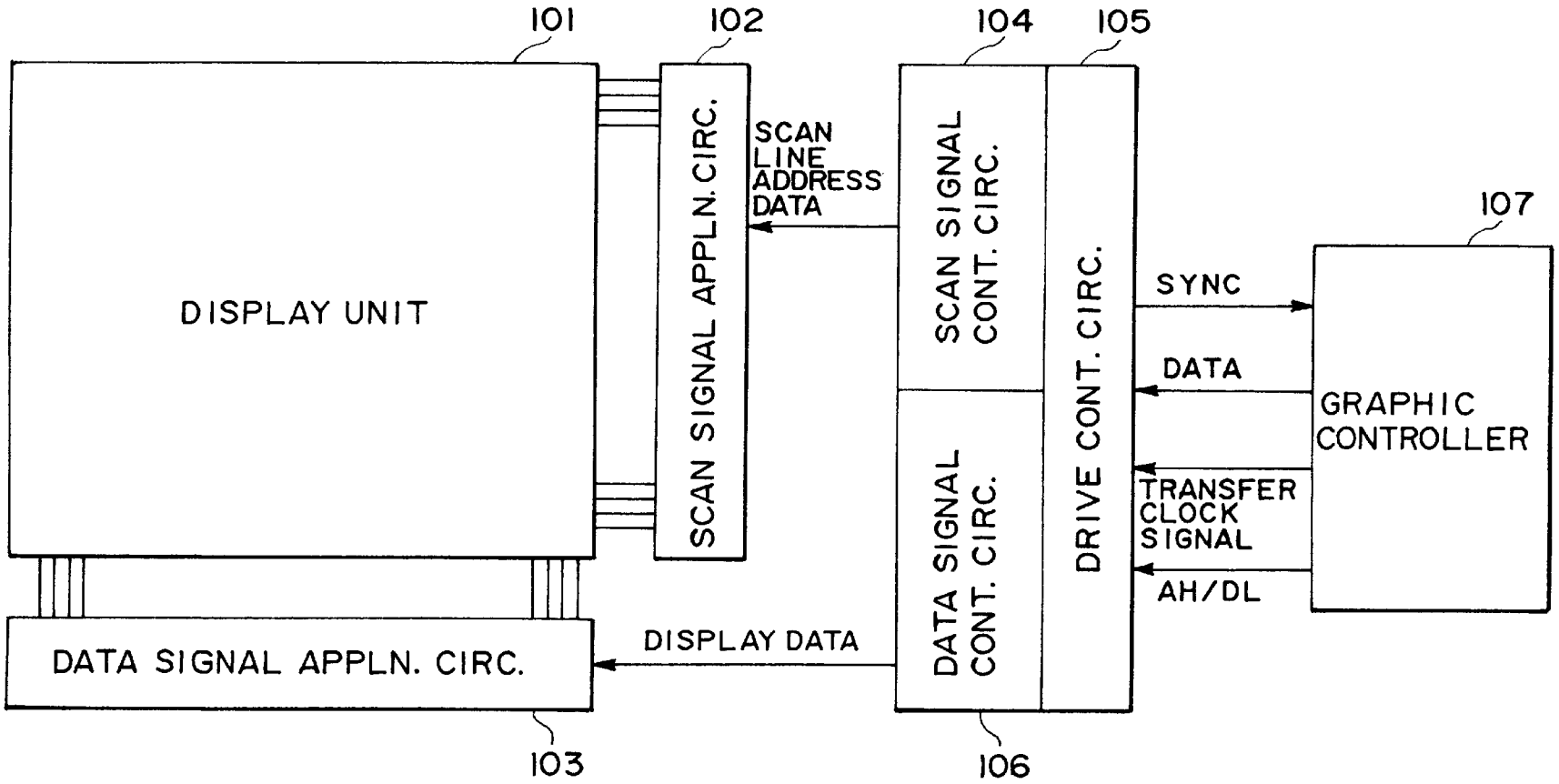
FIG. 10 is a block diagram of a display apparatus including a liquid crystal device driven according to the invention.

FIG. 10 is a block diagram of a display apparatus including a display device driven according to an embodiment of the present invention. Referring to FIG. 10, the display apparatus includes a graphic controller 107, from which data are supplied via a drive control circuit 108 to be inputted to a scanning signal control circuit 104 and a data signal control circuit 106, where the data are converted into address data and display data, respectively. Based on the address data, a scanning signal application circuit 102 generates a scanning selection signal waveform as shown at A in FIG. 3 (or S1–S8 shown in FIG. 9) and a scanning non-selection signal waveform as shown at B in FIG. 3 (or a voltage Vc level preceding to the scanning selection signal waveform at S1–S8 shown in FIG. 9). These scanning selection signal and scanning non-selection signal are applied to scanning electrodes constituting a display unit 101 including 1280×104 pixels. On the other hand, based on the display data, a data signal application circuit 103 generates data signal waveforms as shown at C and D in FIG. 3, which are applied to data electrodes also constituting the display unit 101.

Figure 11:
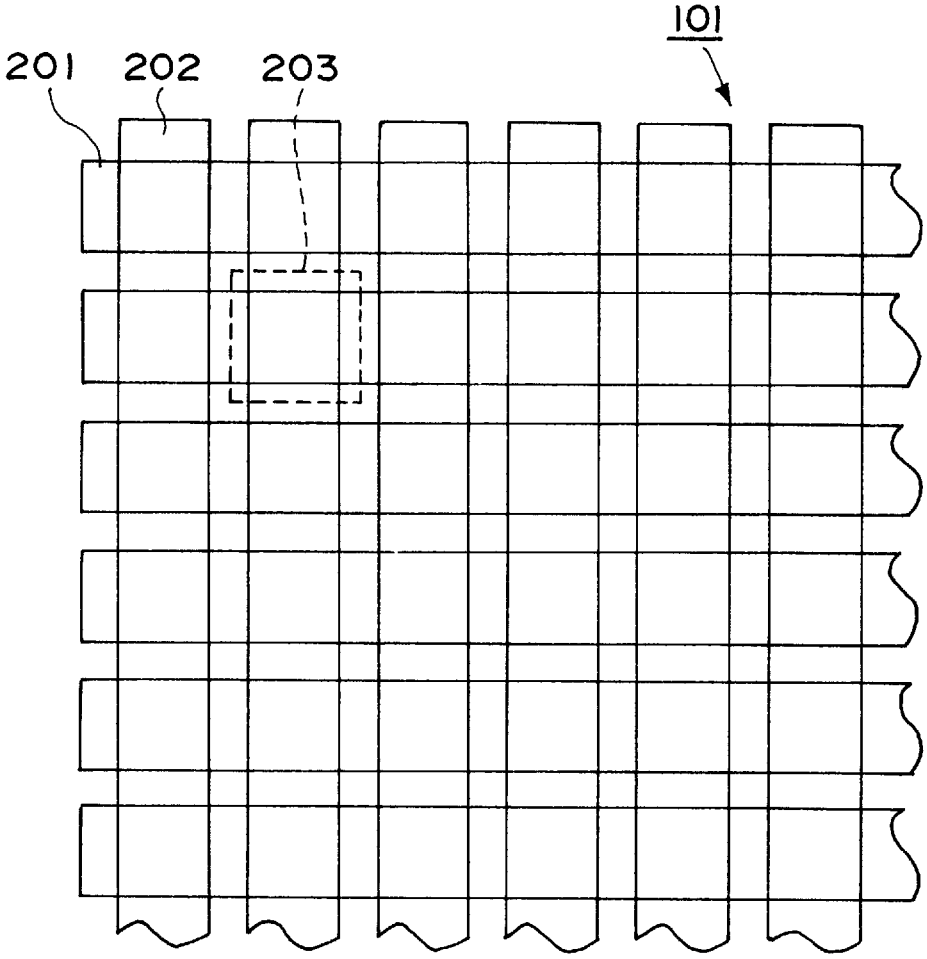
FIG. 11 is a schematic partial plan view of an electrode matrix constituting pixels.

FIG. 11 is an enlarged partial view of the display unit 101 in FIG. 10, showing an electrode matrix including scanning electrodes 201 and data electrodes 202 intersecting the scanning electrodes so as to form a pixel 203 as a display element at each intersection of the scanning electrodes 201 and the data electrodes 202.

Figure 12:
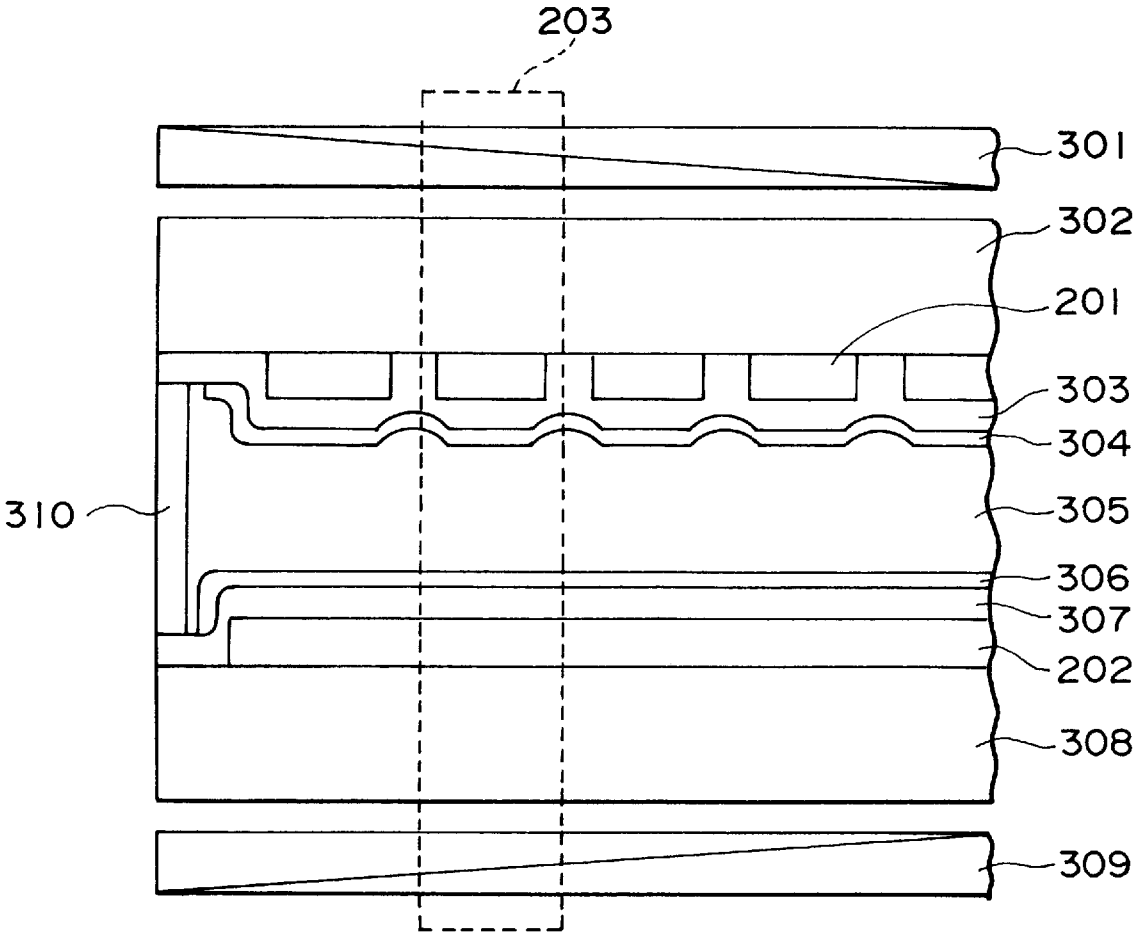
FIG. 12 is a schematic sectional view of a liquid crystal device.

FIG. 12 is a partial sectional view of the display unit (liquid crystal device) 101. Referring to FIG. 12, the liquid crystal device includes a pair of polarizing means, i.e., an analyzer 301 and a polarizer 309 disposed in cross nicols so as to provide a bright display state corresponding to a liquid crystal state of U1 and a dark state corresponding to U2. Between the polarizing means 301 and 309, the liquid crystal device further includes glass substrates 302 and 308 which are respectively provided with stripe-form transparent electrodes 201 and 202 of, e.g., ITO (indium tin oxide), insulating films 303 and 307, and alignment films 304 and 306. A liquid crystal 305 of, e.g., a ferroelectric liquid crystal is disposed between the alignment films 304 and 306 and is hermetically sealed by a sealing member 310.

In case of providing a reflective-mode liquid crystal device, one side of substrate and electrode (e.g., 308 and 202) need not comprise transparent materials, such as glass and ITO.

The liquid crystal 305 used in the present invention may preferably comprises a chiral smectic liquid crystal material providing a relatively large pretilt angle and a chevron structure in C1 alignment in combination with alignment films. A preferred example thereof may include a composition comprising a mesomorphic compound having a phenylpyrimidine skeleton and a fluorine-containing compound as a chiral dopant.

The alignment films 304 and 306 may comprise an obliquely deposited film of an inorganic substance, such as SiO, or an organic substance, such as polyimide. In order to provide a pretilt angle of 10 degrees or higher, it is preferred to use a rubbed film of a fluorine-containing polyimide.

The rubbing may preferably be applied to a pair of substrates 302 and 308 more exactly to alignment films 304 and 306, in directions which are generally identical to each other but cross each other with a certain angle therebetween. Such a manner of rubbing may be referred to as "cross rubbing".

In case of a high pretilt alignment as to provide a pretilt angle of 10 degrees or higher, there can occur a phenomenon that liquid crystal molecules move along inner surfaces of the substrates under application of drive voltages. The driving method according to the present invention is believed to show an effect of suppressing such liquid crystal molecular movement.

As another means for suppressing such a liquid crystal molecular movement, it has been known to provide the alignment films with microscopic projections. In this case, however, some alignment defect is liable to occur at the projections. The driving method according to the present invention is also expected to suppress such an alignment defect.

The present invention will now be described with reference to a more specific embodiment.

EXAMPLE 1

A glass substrate was coated with a color filter comprising four-types of segments including three primary color segments of red (R), green (G) and blue (B) each comprising a resin film with a respective color pigment dispersed therein and a clear segment (W) free of dispersed pigment so that each segment corresponded to a display pixel.

The color filter was coated with an insulating smoothening film, then with an ITO film and then with a metal film of a lower resistivity. The ITO film and the metal film thereon were patterned by etching into ITO stripes and narrower metal stripes disposed along one side each of the ITO stripes.

The above substrate was further coated with a Ti-Si composite oxide film containing fine particles and provided with projections corresponding to the fine particles for suppressing liquid crystal molecular movement, and further coated with a film of a fluorine-containing polyimide, which was then rubbed in a prescribed direction with a rubbing roller to provide an alignment film.

Thus, one side of substrate was prepared.

Separately, another but identical glass substrate was provided with ITO stripes, narrower metal stripes, an oxide film and an alignment film of fluorine-containing polyimide in identical manners for the preparation of the above-mentioned one substrate.

The resultant two substrates were superposed with each other so that their stripe ITO electrodes crossed each other and applied to each other with spacer beads and a particulate adhesive appropriately dispersed therebetween so as to provide a spacing therebetween of ca. 1–3 $\mu$m.

A blank cell prepared in the above-described manner was then filled with a liquid crystal material having physical properties as shown below and cooled to align the liquid crystal in a chevron structure of C1 alignment.

Ps=6.1 nC/cm (at 30° C.)

Tilt angle=14.6 degrees (at 30° C.)

$\Delta\epsilon$=−0.2 (at 30° C.)

Phase transition series (° C.)

$$\text{Iso.} \underset{91.8}{\overset{91.5}{\rightleftharpoons}} \text{Ch.} \underset{85.7}{\overset{85.0}{\rightleftharpoons}} \text{SmA} \overset{66.7}{\rightleftharpoons} \text{SmC*} \underset{-12.5}{\overset{-16.7}{\rightleftharpoons}} \text{Cryst.}$$

The ITO stripe electrodes of the above-prepared liquid crystal device were connected to driver ICs capable of supplying voltage signals shown in FIG. 3, and the driver ICs (scanning signal application circuit 102 and data signal application circuit 103 in FIG. 10) were further connected with drivers as shown in FIG. 10 to provide a color liquid crystal display apparatus.

Referring again to FIG. 3 showing a set of drive signals applied in the apparatus of FIG. 10, at A is shown a scanning selection signal, at B is shown a scanning non-selection signal, at C is shown a data signal for displaying "bright", at D is shown a data signal for displaying "dark", 1H denotes one horizontal scanning period, and $\Delta T$ denotes a selection period.

Figure 13A:
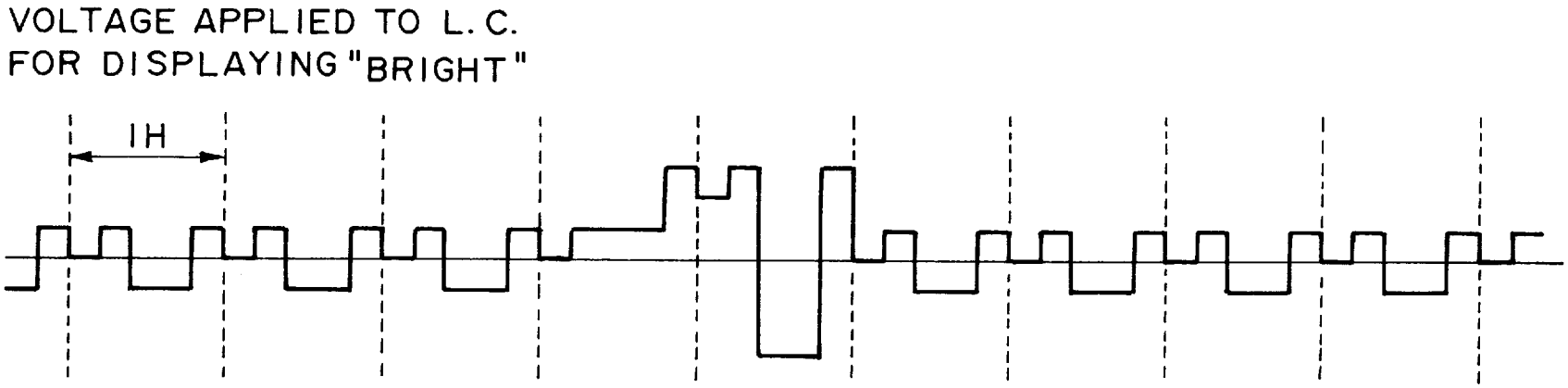
FIGS. 13A and 13B are time-serial waveform diagrams showing successions of voltage signals applied to pixels (liquid crystal) for displaying "bright" and "dark", respectively, according to an embodiment of the invention.
Figure 13B:
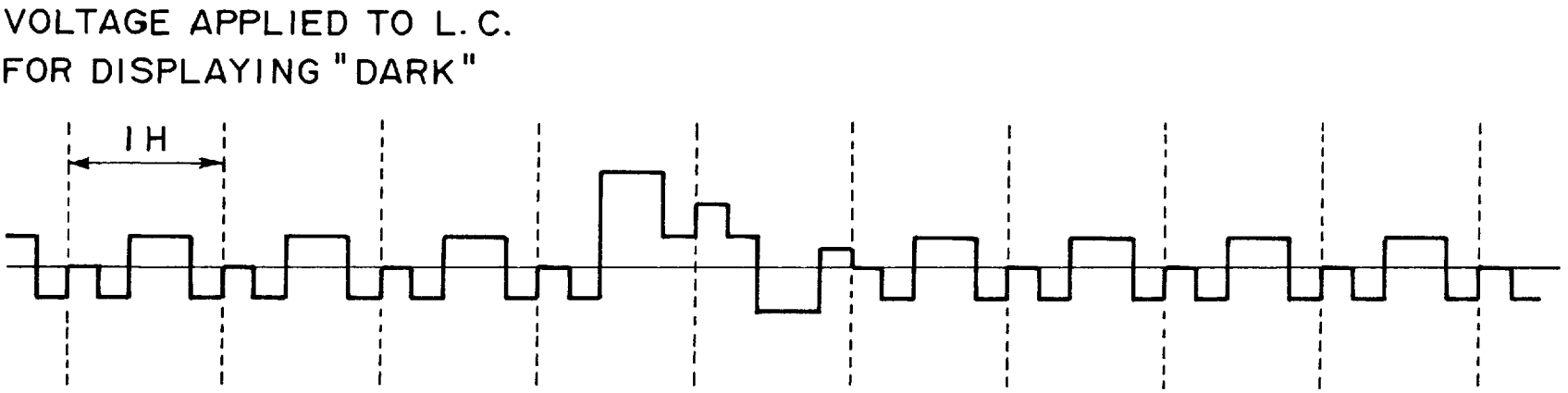

FIGS. 13A and 13B are respectively a time serial waveform applied to a certain pixel in case of displaying a "bright" state and in case of displaying a "dark" state, respectively, at all the pixels on a data electrode concerned by using the signals shown in FIG. 3.

Figure 14A:
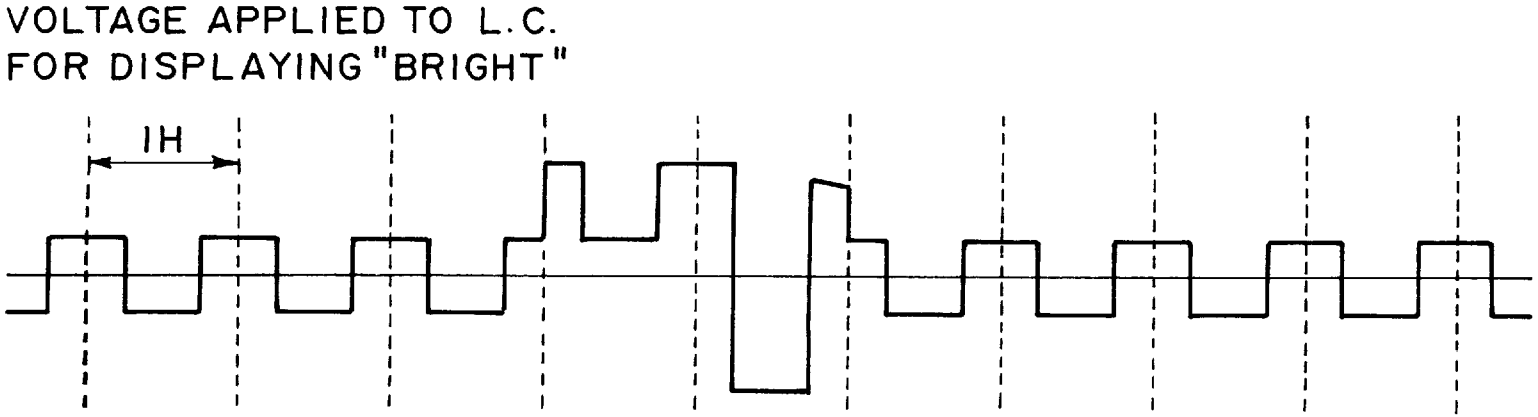
FIGS. 14A and 14B are time-serial waveform diagrams showing successions of voltage signals applied to pixels (liquid crystal) for displaying "bright" and "dark", respectively, according to a known method.
Figure 14B:
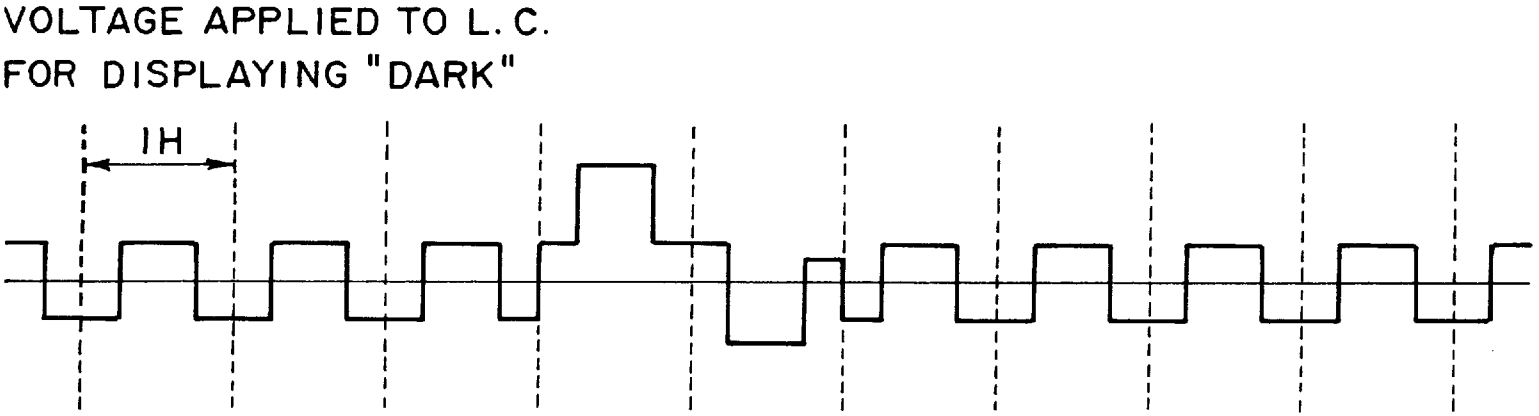

In contrast thereto, FIG. 1 shows a conventional set of drive signals corresponding to those shown in FIG. 3, and FIGS. 14A and 14B respectively show a time serial waveform applied to a certain pixel in case of displaying a "bright" state and in case displaying a "dark" state, respectively, at all the pixels on a data line concerned corresponding to FIG. 13A and 13B, respectively.

The display apparatus prepared in the above-described manner was driven by applying the drive signals shown in FIG. 3 under a set drive conditions of V1=14.3 volts, V2=−143 volts, V3=5.7 volts, V4=−5.7 volts, V5=6.4 volts, and $\Delta T$=80 $\mu$sec at a temperature of 10° C., whereby good display was accomplished over an entire display area with a good drive margin and at a high frame frequency.

It has been also confirmed that the above driving method according to the present invention can exhibit good performances with other materials and other device structures.

As described above, according to the present invention, the frequency of application of pulses causing a remarkable fluctuation of a liquid crystal state is suppressed by application of a pause period between successive data signals, thereby providing a stable drive margin, a high frame frequency and a simplified drive circuit in combination.

What is claimed is:

1. A driving method for a liquid crystal device of the type comprising an electrode matrix comprising scanning electrodes and data electrodes intersecting the scanning electrodes, and a liquid crystal disposed to form a pixel at each intersection of the data electrodes and the scanning electrodes, the liquid crystal at each pixel being a chiral smectic liquid crystal placed in C1 alignment state of chevron structure, said driving method comprising:

sequentially applying a scanning selection signal to the scanning electrodes; and in synchronism with the scanning selection signal, applying data signals to the data electrodes, each data signal comprising a selection pulse of a first polarity having a pulse width $\Delta T$ for determining a display state of a pixel and pulses of a second polarity disposed before and after the selection pulse, wherein the data signals are applied successively with a pause period shorter than ΔT between successive two data signals sufficient to stabilize the C1 alignment state of the liquid crystal, wherein the scanning selection signal comprises a scanning selection pulse having a pulse width ΔT and a reset pulse having a pulse width longer than ΔT and preceding the scanning selection pulse, and the scanning selection signal is sequentially applied to the scanning electrodes so that the reset pulse is applied to a scanning electrode simultaneously with application of the scanning selection pulse to another scanning electrode, and a total duration of each data signal and the pause period is equal to one horizontal scanning period.

2. A method according to claim 1, wherein the pause period is synchronized with a reset pulse applied to any one of the scanning electrodes.

3. A method according to claim 1, wherein the liquid crystal is a chiral smectic liquid crystal.

4. A driving method for a liquid crystal device of the type comprising an electrode matrix comprising scanning electrodes and data electrodes intersecting the scanning electrodes, and a liquid crystal disposed to form a pixel at each intersection of the data electrodes and the scanning electrodes, the liquid crystal at each pixel being a chiral smectic liquid crystal placed in C1 alignment state of chevron structure, said driving method comprising:

sequentially applying a scanning selection signal to the scanning electrodes; and in synchronism with the scanning selection signal, applying data signals to the data electrodes, each data signal comprising a selection pulse of a first polarity having a pulse width ΔT for determining a display state of a pixel and auxiliary pulses of a second polarity disposed before and after the selection pulse and each having a pulse width of ΔT/2, wherein the data signals are applied successively with a pause period of ΔT/2 between two successive data signals sufficient to stabilize the C1 alignment state of the liquid crystal so that the auxiliary pulses will not continue, the scanning selection signal comprises a scanning selection pulse having a pulse width ΔT and a reset pulse having a pulse width longer than ΔT and preceding the scanning selection pulse, and the scanning selection signal is sequentially applied to the scanning electrodes so that the reset pulse is applied to a scanning electrode simultaneously with application of the scanning selection pulse to another scanning electrode, and a total duration of each data signal and the pause period is equal to one horizontal scanning period.

* * * * *

UNITED STATES PATENT AND TRADEMARK OFFICE

CERTIFICATE OF CORRECTION

PATENT NO. : 5,886,678

DATED : March 23, 1999

INVENTOR(S) : KAZUNORI KATAKURA ET AL.

It is certified that error appears in the above-identified patent and that said Letters Patent is hereby corrected as shown below:

[56] REFERENCES CITED

Foreign Patent Documents
"2281233 11/1990 Japan" should read
--2-281233 11/1990--.
"2281238 11/1990 Japan" should read
--2-281238 11/1990 Japan--.

COLUMN 1

Line 36, "device. A conventional" should read
--device. ¶ A conventional--.

COLUMN 6

Line 24, "a" (second occurrence) should read
--α-.

UNITED STATES PATENT AND TRADEMARK OFFICE

CERTIFICATE OF CORRECTION

PATENT NO. : 5,886,678

DATED : March 23, 1999

INVENTOR(S) : KAZUNORI KATAKURA ET AL.

It is certified that error appears in the above-identified patent and that said Letters Patent is hereby corrected as shown below:

COLUMN 7

Line 67, "ΔAT" should read --ΔT--.

Signed and Sealed this

Fourteenth Day of December, 1999

*Attest:*

Q. TODD DICKINSON

*Attesting Officer*

*Acting Commissioner of Patents and Trademarks*